US010334946B2

(12) United States Patent
Guivol et al.

(10) Patent No.: US 10,334,946 B2
(45) Date of Patent: Jul. 2, 2019

(54) MOVABLE CABINETS

(71) Applicants: Amiel Guivol, Nesher (IL); Shoolamit Guivol, Nesher (IL)

(72) Inventors: Amiel Guivol, Nesher (IL); Shoolamit Guivol, Nesher (IL)

(73) Assignee: CABINETICS INNOVATIONS LTD., Nesher (IL)

( * ) Notice: Subject to any disclaimer, the term of this patent is extended or adjusted under 35 U.S.C. 154(b) by 30 days.

(21) Appl. No.: 15/319,490

(22) PCT Filed: Jun. 17, 2015

(86) PCT No.: PCT/IL2015/050614

§ 371 (c)(1),
(2) Date: Dec. 16, 2016

(87) PCT Pub. No.: WO2015/193895

PCT Pub. Date: Dec. 23, 2015

(65) Prior Publication Data

US 2017/0303683 A1 Oct. 26, 2017

(30) Foreign Application Priority Data

Jun. 17, 2014 (IL) ..... 233201

(51) Int. Cl.

| | |
|---|---|
| ***A47B 51/00*** | (2006.01) |
| ***A47B 46/00*** | (2006.01) |
| ***A47B 81/00*** | (2006.01) |
| ***A47B 77/08*** | (2006.01) |
| ***A47B 77/02*** | (2006.01) |
| *A47F 3/06* | (2006.01) |

(52) U.S. Cl.

CPC ..... *A47B 51/00* (2013.01); *A47B 77/02* (2013.01); *A47B 77/08* (2013.01); *A47B 81/002* (2013.01); *A47B 2051/005* (2013.01); *A47F 3/06* (2013.01)

(58) Field of Classification Search

CPC ..... A47B 51/00; A47B 46/005; A47B 46/00; A47B 77/02; A47B 77/08; A47B 81/002

See application file for complete search history.

(56) References Cited

U.S. PATENT DOCUMENTS 844,338 A * 2/1907 Ellett et al. ..... A47B 51/00 312/312
2,429,523 A * 10/1947 Murphy ..... A47B 51/00 187/275

(Continued)

FOREIGN PATENT DOCUMENTS

DE 3215572 A1 * 10/1983 ..... A47B 51/00
DE 3801313 A1 7/1989

(Continued)

*Primary Examiner* — Kimberley S Wright

(57) ABSTRACT

A Highly Hung Vertically Moveable Cabinet (HHVMC) comprising a cabinet having a bottom and a top essentially parallel thereto; and an electrical motion system configured to allow movement of the cabinet to a predetermined distance of at least 500 mm in a first direction and in a second opposite direction. Both first direction and second direction being essentially normal to the cabinet bottom and top, and switches electrically coupled to the motion system, wired to allow selection of the movement in the first or second direction.

20 Claims, 12 Drawing Sheets

(56) References Cited

U.S. PATENT DOCUMENTS 2,499,791 A * 3/1950 Spencer ..... A47B 51/00 312/247
2,506,086 A * 5/1950 Jess ..... A47B 51/00 126/19 M
2,634,186 A * 4/1953 Zuss ..... A47F 3/06 312/201
2,889,442 A * 6/1959 Schultz ..... F24C 7/08 126/19 M
3,028,209 A * 4/1962 Hinkel ..... A47B 77/04 312/228
3,285,682 A * 11/1966 Nelson ..... A47B 51/00 312/247
3,415,586 A * 12/1968 Hammond ..... A47B 51/00 108/147
3,552,049 A * 1/1971 Foote ..... G09F 11/26 40/472
3,933,400 A * 1/1976 Helgeson ..... A47B 49/008 312/319.7
6,471,311 B1 * 10/2002 Snyder ..... A47B 51/00 312/245
6,494,150 B1 * 12/2002 Phoenix ..... A47B 51/00 108/147
6,676,233 B1 * 1/2004 Evans ..... B66B 9/02 108/147.11
7,052,066 B2 * 5/2006 Emery ..... B60R 11/06 296/37.1
7,128,003 B2 * 10/2006 Okninski ..... A47B 81/064 108/147
7,341,054 B2 * 3/2008 Kuttalek ..... F24C 15/027 126/19 M
7,360,980 B2 4/2008 Brewer
8,113,606 B2 * 2/2012 Greenberg ..... A47B 51/00 312/271
8,414,093 B2 4/2013 Moran
8,556,355 B2 10/2013 Greenberg
8,955,648 B1 * 2/2015 Weller ..... B66B 9/00 187/262
9,084,481 B2 * 7/2015 Hollenstein ..... A47B 51/00
9,743,763 B1 * 8/2017 Ordovas ..... A47B 77/04
9,788,651 B1 * 10/2017 Hall ..... A47B 51/00
2004/0155476 A1 * 8/2004 Emery ..... B60R 11/06 296/37.6
2004/0221775 A1 * 11/2004 Okninski ..... A47B 81/064 108/147
2006/0066188 A1 * 3/2006 Crawford ..... A47B 51/00 312/247
2007/0108791 A1 * 5/2007 Okninski ..... A47B 81/064 296/97.12
2007/0241650 A1 * 10/2007 Schmitt ..... A47B 51/00 312/312
2009/0058237 A1 * 3/2009 Bally ..... F24C 7/08 312/228
2009/0179538 A1 * 7/2009 Greenberg ..... A47B 51/00 312/237
2010/0072868 A1 * 3/2010 Deem ..... E06B 3/925 312/319.7
2011/0298346 A1 12/2011 Stone
2012/0031867 A1 * 2/2012 Weyler ..... A47B 46/00 211/153
2012/0194042 A1 * 8/2012 Greenberg ..... A47B 46/00 312/107
2014/0116968 A1 * 5/2014 Krohn ..... A47B 61/02 211/1.51
2014/0197720 A1 7/2014 Sorbara et al.
2014/0252930 A1 * 9/2014 Reid ..... A47B 46/005 312/247
2016/0130806 A1 * 5/2016 Strand ..... G10K 11/16 181/287
2016/0135593 A1 * 5/2016 DeLorean ..... E04B 9/003 52/1
2016/0278517 A1 * 9/2016 DeLorean ..... E04B 1/7069
2016/0360879 A1 * 12/2016 Kelley ..... A47B 21/06

FOREIGN PATENT DOCUMENTS

EP 2218354 A2 8/2010
GB 2407253 A 4/2005
JP 2006288961 A 10/2006
JP 2010252936 A 11/2010

* cited by examiner

A

B

MOVABLE CABINETS

CROSS-REFERENCE TO RELATED PATENT APPLICATIONS

This patent application is a U.S. National Phase Application filing under 35 U.S.C. § 371 of PCT Patent Application No. PCT/IL2015/050614, filed Jun. 17, 2015, which in turn is based upon and claims the benefit of the filing date of Israeli Patent Application No. 233201, filed Jun. 17, 2014, each of which is incorporated herein by reference in its entirety.

TECHNICAL FIELD

The present invention relates to the field of storage and furniture technology.

BACKGROUND OF THE INVENTION

Storage volume is an essential, valuable characteristic of houses, store houses, warehouse etc. Wardrobes, chest of shelves, chests of drawers and cabinets are used as a major storage medium, but too many of them in a given space, especially if they are all on the floor, become an obstacle, as well as an overcrowding, aesthetic problem. Storage space shortage of every-day items is acute in small apartments and studios, comprising only one or two rooms. Almost every built space comprises free volumes close to the ceiling, and even though they have the potential of being used instead of occupying floor areas, they are not utilized in prior art, mainly because of the lack of a comprehensive affordable price solution.

Cited Prior Art

U.S. Pat. No. 8,414,093: This patent is intended for disabled people on wheelchair, it deals with lowering of shelves from within an upper kitchen cabinet to the worktop level, this is done by simultaneously performing two movements, in the vertical and the horizontal direction; the last requires opening of the relevant cabinet doors.

Our invention is primarily intended for the general population and furthermore, not only for kitchens; only vertical movement is performed and an affordable common used motion system is used.

With the Highly Hung Vertical Moveable Cabinet (HHVMC), and CORNER HHVMC the whole cabinet is moving up and down and not only the shelves.

With the SHAFT CORNER HHVMC our patent refers only to the corner between the upper cabinets of a kitchen, the referred patent could not be apply in this case because the movement in the horizontal side is impossible (there are no doors to be opened . . . ).

US20140197720: This patent application is also intended for disabled people on wheelchair, it deals with lowering one cabinet from within a wider one; again a simultaneous movements are used, one in the vertical and the other in the horizontal direction;

This invention is similar to the previous one, except that it saves the need for completely redesigns and/or reinstalls the cupboards and/or cabinets, but to use existing ones as the inner movable items.

US2011/0298346: This patent application deals with lowering cabinets in the vertical direction. This invention does not include electrical motion system; lowering and lifting of the cabinet is performed by the user power; as such, the cabinets are limited to a small insufficient storage loads.

SUMMARY OF THE INVENTION

Vertically moveable cabinets, designed to increase storage capacity, while not occupying valuable floor areas. This is achieved by using high, close to the ceiling room volumes, including above windows and doors spaces and vertical room's corners, which are rarely used in prior art. The suggested cabinets are installed with a large enough clearance to the floor, and thus do not risk nearby persons, or overcrowd the room.

Stored items are easily reached by lowering the cabinets to an accessible height. The suggested motion system is a novel use of a prior art tubular motor and accompanying accessories, which are widely used for lifting and lowering shutters and blinds. Protection against a possible dropping, due to a technical failure, is accomplished by adaption of retractable vehicle safety belts. Stabilization of the vertical path is achieved by telescopic rails.

Some of the concepts described above are further used to enhance the usage and accessibility of corner volumes of corner kitchens cabinets.

The suggested invention would be of great benefit to the wide population and particularly to disabled people and children having difficulties reaching elevated stored items.

According to one aspect, a Highly Hung Vertically Moveable Cabinet (HHVMC) is provided, comprising:

A cabinet having a bottom and a top essentially parallel thereto;

An electrical motion system configured to allow movement of the cabinet to a predetermined distance of at least 500 mm in a first direction and in a second opposite direction, both first direction and second direction being essentially normal to the cabinet bottom and top, and switches electrically coupled to the motion system, wired to allow selection of the movement in the first or second direction.

The HHVMC further comprises at least two telescopic rails configured to allow stabilization of the movement.

In some embodiments the HHVMC is shaped as a right angle triangular prism with door/s at a hypotenuse of the prism (a CORNER HHVMC).

Further provided is a SCVMC (Shaft Corner Vertically Moveable Cabinet), intended to installation within the trapped volume between the higher or lower cabinets of a corner cabinet kitchen. The SCVMC comprises a vertically movable insert cabinet installed within a trapped volume of corner kitchen cabinets According to another aspect, an array of HHVMCs is provided, installed in structures selected from a group comprising warehouses, storehouses, exhibition halls and houses, wherein the HHVMCs are installed one next to another and proximal to ceiling areas in the structures.

In the array the structures may comprise floors, and wherein the cabinets of the HHVMCs are installed such that a distance between the cabinet bottom and the floor is at least 1900 mm.

The cabinet top comprises in some embodiments a groove housing at least part of the electrical motion system.

The electrical motion system may comprise a motor and a curtain, the curtain is fully rolled into the groove when the cabinet is proximal to the ceiling. The HHVMC may further comprise means to allow manually moving the cabinet the predetermined distance in at least one direction.

According to another aspect, a method is provided comprising:

Providing a Highly Hung Vertically Moveable Cabinet (HHVMC) and an electrical motion system; installing the HHVMC at the upper volume of a built space with some 1900 mm clearance between a bottom of the HHVMC and a floor of the built space, in the up most travel position of the HHVMC, the clearance furthermore enabling installation above windows and doors in the built space; wherein the HHVMC has an aspect ratio higher than 1:1; and to gain asses to stored items in the HMMVC, the HHVMC is lowered some 500 mm and more by the electrical motion system; and wherein stabilization of the vertical motion is based on two or more telescopic rails.

In some embodiments the HHVMC is shaped as a right angle triangular prism with door/s at its hypotenuse (a CORNER HHVMC), allowing good accessibility to stored items within the HHVMC, wherein the HHVMC is installed at vertical corners of the built space.

In some embodiments there is provided SCVMC and an electrical motion system; installing the SCVMC at a shaft formed by a kitchen room corner and upper or lower kitchen wall cabinets proximal thereto; lowering and lifting the SCVMC in a space behind the kitchen wall cabinets, by the electrical motion system; and stabilizing the lowering and lifting with two or more telescopic rails.

Some embodiments further comprise restraining dropping due to technical failure of the HHVMC or SCVMC with retraceable vehicle safety belts.

In some embodiments the cabinet top comprises a groove housing at least part of the electrical motion system.

In some embodiments the motion system comprises a curtain, or at least one strap used as a medium to lift and lower the HHVMC or the SCVMC by wrapping/unwrapping round a rotating axle.

According to another aspect a method is provided of installing an array of HHVMCs in built spaces selected from a group consisting of: warehouses, storehouses, exhibition halls etc, wherein the HHVMCs are installed one next to the other on ceiling areas in the built spaces; whereby the HHVMCs arrays provide large storage volume in high zones of the built spaces.

The suggested invention deals with using the top space of rooms as storage spaces, without occupying floor areas, or risking the users or nearby passing persons; this is achieved by HHVMC. HHVMCs located above persons heads, near the ceiling corners, and/or above windows and doors.

Especially with warehouses and store houses, this idea might be extended to an array of HHVMCs, installed each next to the other, on ceiling areas, hence freeing the floor for wide, open and comfortable merchandise exhibition and traffic.

Some of the benefits of this invention are suggested for more efficient storage volume and improved accessibility of prior art, corner kitchen cabinets.

In a first aspect, the suggested solution is directed to a HHVMC comprising chests of drawers or chests of shelves (later on, all referred to as HHVMC).

HHVMCs are hung with a clearance of some 1900 mm from the floor, FIG. 1 demonstrates this structure by showing HHVMC (1) hung above an opened window (2) and an opened wing window (3); the mentioned clearance is implemented in order not to risk nearby passing people, not to over-crowd the space, and to allow installation above windows and doors; smaller clearance may be applied where the floor area beneath the HHVMC is already taken by some other furniture, thus not fully using the non overcrowding benefit, but still preventing the risk of people colliding with the highly hung cabinets.

In some cases, especially above windows, the remaining clearance to the ceiling would be less than 500 mm.

To compensate for the relatively low height and storage volume, two major solutions are given:

a. The HHVMC may have a very large aspect ratio, starting with 1:1 and ending with 10:1 and more (width over height).
b. The motion system (7, in FIG. 2), is located above the HHVMC, this enables to "embed" it in the HHVMC roof, as depicted in views "B" and "C", "wasting" its volume only, rather than all the volume it would have been taken between the HHVMC and the ceiling, as in view "A". The gained volume is noticed by comparing the height of the HHVMC in view "A" to the one in views "B" and "C".

The large aspect ratio of a moving cabinet may lead to large deflection, the solution to this problem is achieved by hanging the cabinet on a "curtain" all along, so that the load is equally divided and carried against the rigid structure side of the curtain and a rigid tube carrying the curtain.

The HHVMC is moved up and down to provide the users with good accessibility to the stored items. To achieve that, the HHVMC ceiling is lowered a distance of some 500 mm , to some 1900 mm from the floor as shown in FIG. 2 view "C" and even lower for chests of drawers; reducing this height furthermore, allows accessibility for children and disabled persons especially those persons using a wheel chair.

In a second aspect, the present invention is directed to the use of a prior art tubular motor, as means for vertically moving HHVMC and SCVMC; in prior art, this kind of motors and the accompanying mounting accessories is in wide use to automatically operate shutters and blinds only.

The use of a tubular motor for lifting and lowering cabinets is novel.

FIG. 3 depicts an assembly (7), comprising a tubular motor (8), installed within extendable tube (9), a thrust bearing (11) in between and a fitting cup (12); when activated, bearing (11), tube (9) and cup (12), rotate together to wrap/unwrap a strap connected to them (shutter or blind in prior art); further details regarding this assembly construction and operation are provided below.

The following is a list of the advantages of the prior art tubular motor assembly (7), for the novel suggested usage in HHVMC or SCVMC:

The tubular motor is bi-directional and includes an integral gear to reduce its rotary velocity to the range of 10-20 r.p.m,; considering the extendable tube diameter range (discussed below), and a travel of some 500 mm (typical HHVMC or SCVMC travel), less than 10 seconds are needed to lift or lower the HHVMC—This fits well the novel use for HHVMCs.

These kinds of motors are compact and supplied with an electrical power capacity ranging from several to some 900 Watts; the diameter range of the extendable tube is 30-130 mm; those ranges suit well the need for the new suggested embodiment for HHVMCs of up to some 600 kg gross weight, with reasonable traveling velocity and compactness.

The tubular motor includes integral motion limit control: two switches (14) mounted on the motor, are set once to control the number of turns to be performed in each turning direction; activating and altering direction is achieved by a switch mounted on the wall, or by a remote control—this also fits well the novel use for HHVMCs or SCVMCs.

The stroke of tubular motors is very flexible to adjust, and can easily be set to 500 mm and more if needed—This fits well the novel use with HHVMCs or SCVMC The switch or the remote control operating the motor has three states: a lifting state, for lifting to the upmost position; an intermediate state, to stops anywhere in the range of movement; and a lowering state, for lowering to the lowermost position—this also, fits well the novel use for HHVMCs or SCVMCs.

Tubular motors have a further advantage of improved safety of the elevation position, since the off position, as well as a voltage cut-off failure, cause integral braking, thus the HHVCM stops as needed, and cannot drop upon cease of electric power supply—this also, fits well the novel use for HHVMCs and SCVMCs.

Tubular motors systems are also available with a backup manual operation mechanism, this might be relevant for areas suffering from frequent voltage cut-offs (for other cases a ladder may be a satisfactory backup solution)—this also, fits well the novel use for HHVCMs. Tubular motors are produced in mass quantities worldwide, thus have affordable price.—This fits well the novel use for HHVMCs and SCVMCs.

It could be summarized that prior art tubular motor systems used so far for the motion of shutters and blinds, are ideal for the suggested novel usage of HHVMC or SCVMC (a specific tubular motor and accessories still must be selected, referring to the gross cabinet weight, width and the required velocity).

In a third aspect, the present invention refers to a novel use of a prior art retractable seat belts, as a mean for restraining accidental drop of HHVMCs or SCVMCs in case of a mechanical failure. A retractable seat belt is "a vehicle safety device designed to secure the occupant of a vehicle against harmful movement that may result during a collision or a sudden stop" (Wikipedia).

The following is a list of the advantages of prior art retractable seat belts for the novel suggested usage:

Retractable seat belt allows the movement of the restrained person/object with only small force, as long as a negligible acceleration is involved, this is done by unwrapping an extra belt length needed to allow this movement, against a "constant torque" torsion spring, the unwrapping mechanism comprises a centrifugal brake that firmly stops the movement in case of a sudden increased velocity (acceleration)—This fits well the need for restraining a falling HHVMCs or SCVMCs, the belt allows a normal movement with only negligibly overloading the motor on one hand, and on the other hand prevents falling by responding to the gravity acceleration in case of a mechanical failure.

Retractable seat belts are produced in mass quantities and under severe quality requirements, and thus combine high reliability with affordable price.—This fits well the novel use for restraining HHVMCs or SCVMCs.

Retractable seat belts are designed to deal with high impact loads of some 75 kg, exposed to tens of "g", thus can easily deal with loads of falling HHVMCs, weighing hundreds of kg with only one "g" of gravity acceleration.

With large aspect HHVMCs the suggested requirement for cabinets restraining mechanisms would be at least two retractable seat belts, at two different sides of the lateral (wide) centre of gravity of the HHVMC, this gives an extra margin of safety.—This fits well the novel use for restraining HHVCMs.

Retractable seat belts have a stroke of some 1500 mm—This stroke, fits the novel use for eased installation and use with restraining HHVMCs or SCVMCs.

It could be summarized that retractable vehicle seat belts are an ideal novel use for restraining HHVMC and SCVMC; depending on the aspect ratio of the HHVMC, the number of required retractable belts may be more than one.

BRIEF DESCRIPTION OF DRAWINGS

Preferred embodiments, features, aspects and advantages of the present invention, are described herein in conjunction with the following drawings. In principle the drawings are drawn to scale, but not as a mandatory issue.

All sizes are in millimeters.

DESCRIPTION OF EMBODIMENTS

The present invention will be understood from the following detailed description of preferred embodiments ("best mode"), which are meant to be descriptive and not limiting; for the sake of brevity, some well-known features, components, circuits, and so on, are not described in detail.

Figure 1:
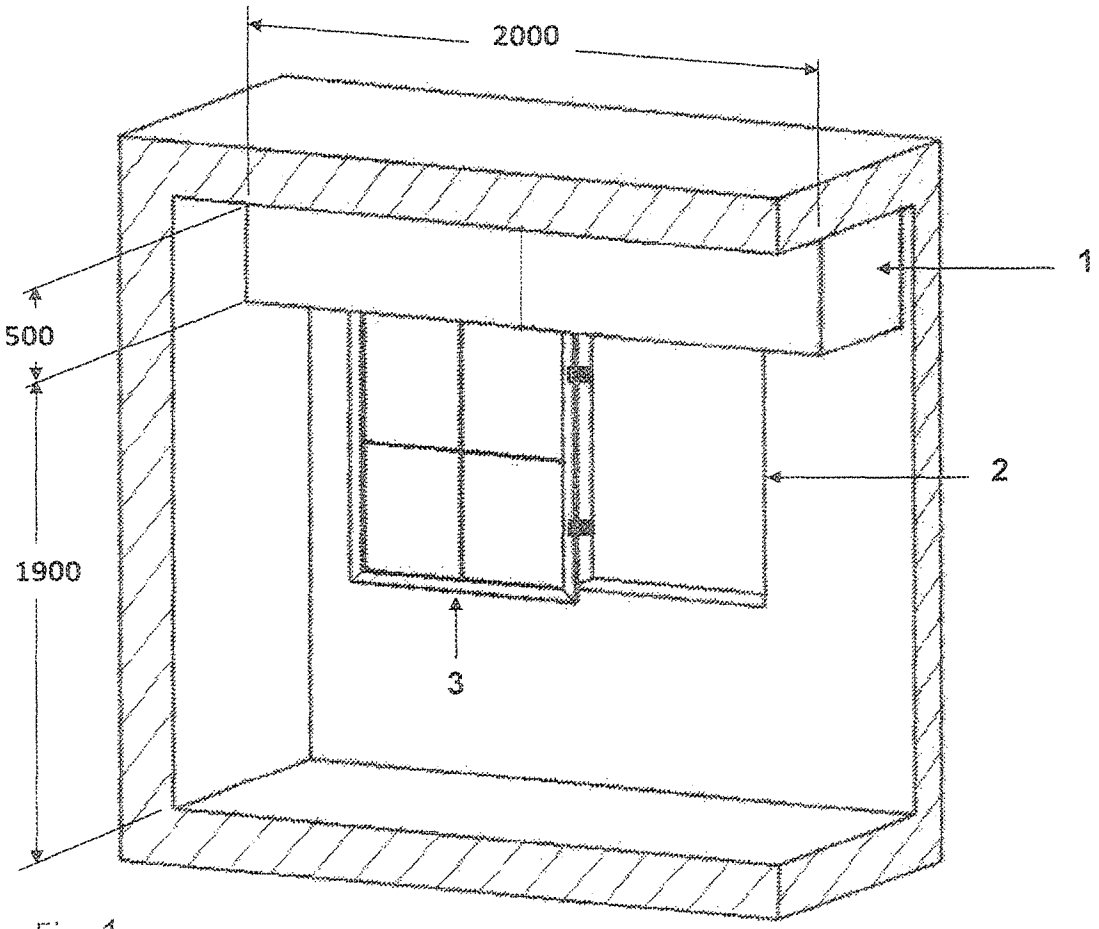
FIG. 1 is a front perspective view of a room installed with a suggested HHVMC, in its upper position, above an opened window.

FIG. 1 is a front perspective view of a two door HHVMC (1) embodiment, installed above a window (2) with an opened window wing (3).

Size 1900 represents a safe clearance for nearby people, allows installation above windows and doors and minimizes room overcrowding. Sizes 500 and 2000 depict a recommended large aspect ratio intended to gain maximal storage volume on one hand and an esthetic "wall to wall" installation; on the other hand, the demonstrated 1:8 aspect ratio should not be considered as an upper limit.

To facilitate mobility trough gates, elevators, etc. the HHVMC may be made of modular pieces assembled each to other at the installation site; in the depicted case, each door represents a separate module; larger sizes HHVMCs may be split into more sub-units as needed.

The motion system is not shown, but in any case it could hardly be seen, as it is hidden behind the HHVMC in looking at the HHVMC doors direction and among the HHVMC side walls and the room walls from other views directions.

It should be noted that during the HHVMC motion, the wing window (3) must be fully closed or fully opened.

Figure 2:
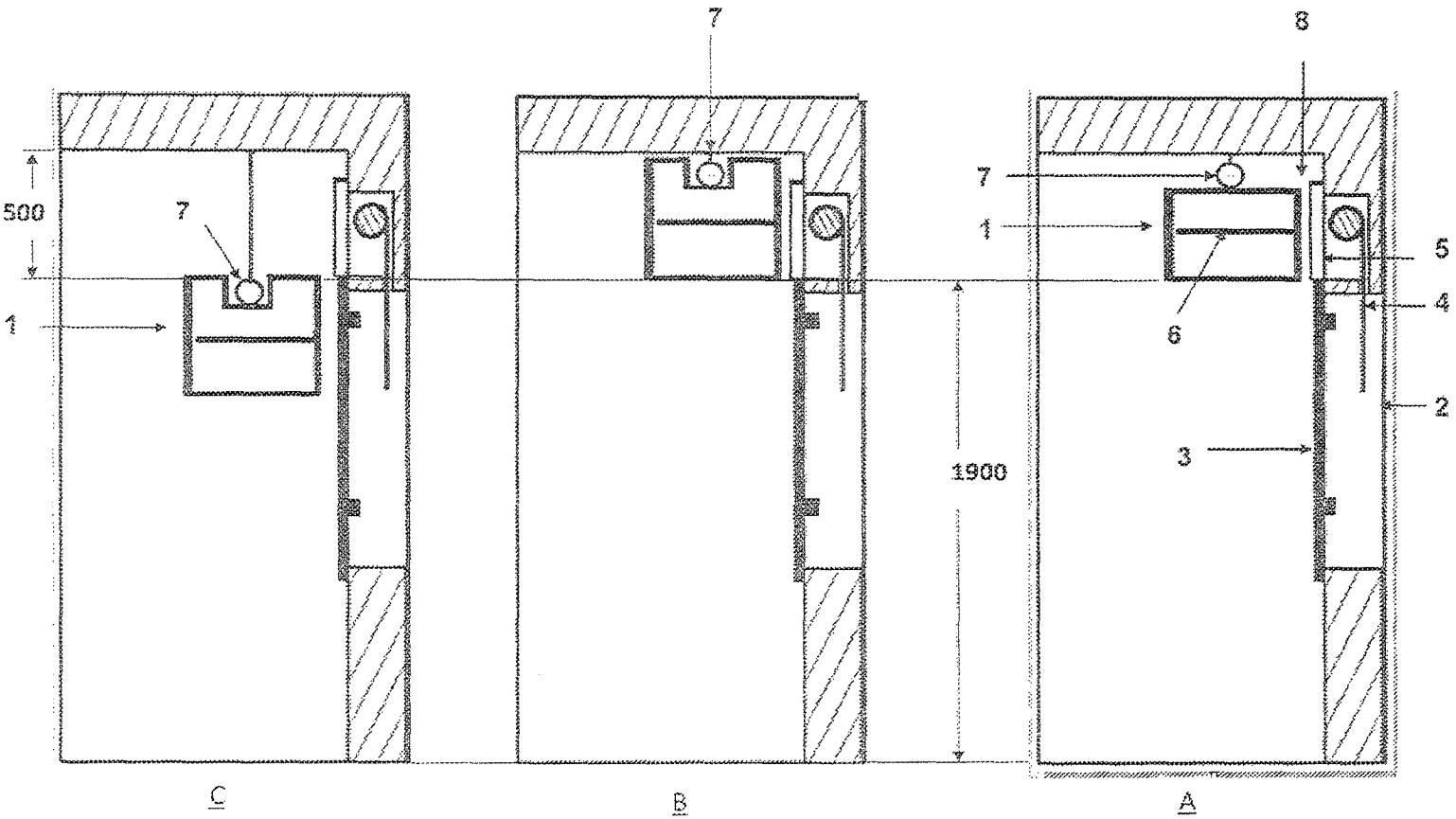
FIG. 2 is a side sectional view of a suggested HHVMC. View "A" shows one embodiment, while views "B" and "C" depict a preferred embodiment in two different elevations.

FIG. 2 shows side sectional views of HHVMC installations above a window (2), comprising a window wing (3), a shutter (4), a shutter cover (5), an HHVMC shelf (6), and a motion system (7). In all cases the motion system (7) is installed above the HHVMC (1); In view "A" the motion system occupies the entire volume between the HHVMC and the ceiling; views "B" and "C" describe a preferred suggested case in two different elevation levels; with this embodiment the motion system (7) is installed within a groove, running all along the HHVMC roof width, thus allowing for a higher HHVMC and larger storage volume.

To prevent collision with possibly installed objects on the wall, such as shutter cover (5), the suggested solution comprises a deliberate gap (8), between the HHVMC backside and the wall.

Figure 3:
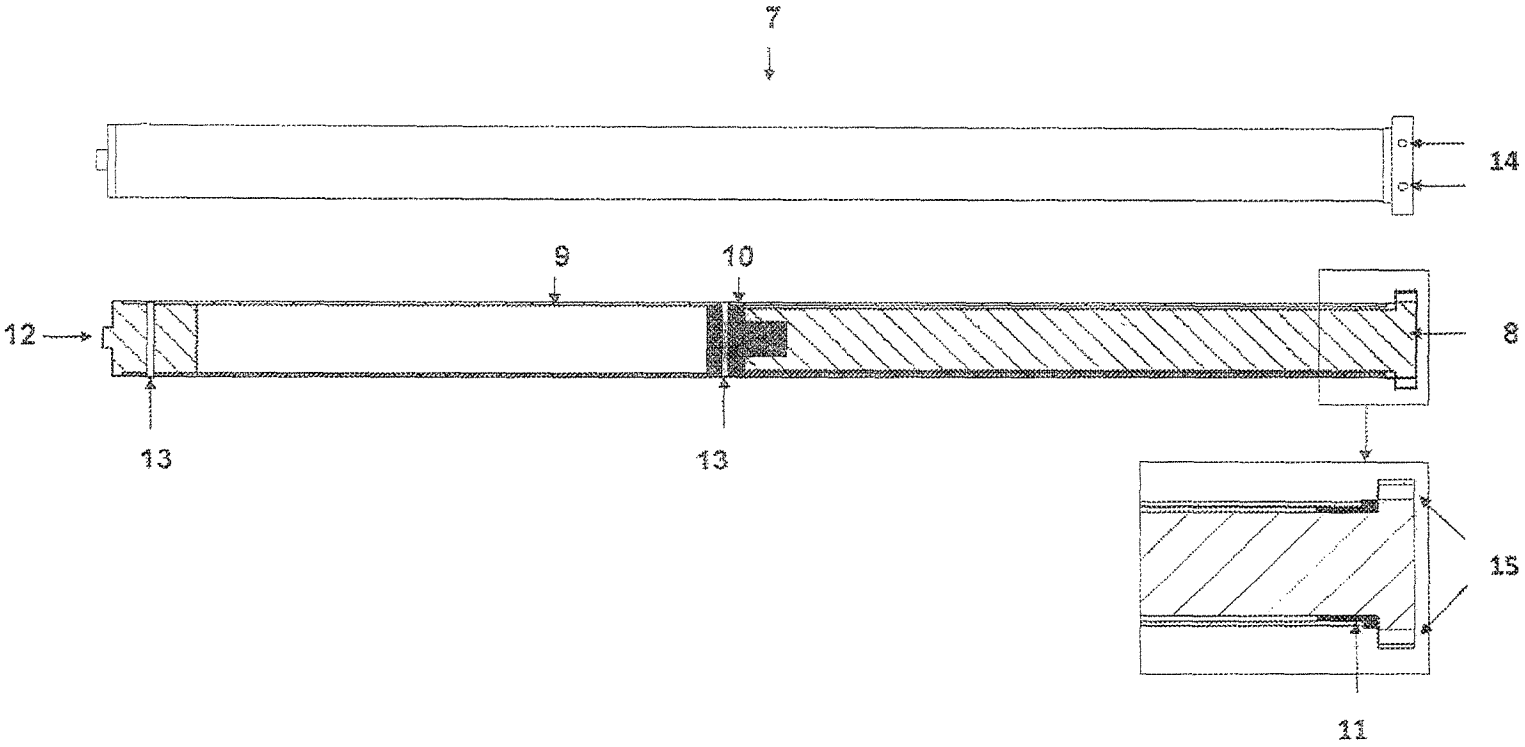
FIG. 3 is a sectional view through a prior art tubular motor assembly.

FIG. 3 is a sectional view of a prior art tubular motor assembly (7). The assembly comprises a prior art tubular motor (8), an extendable tube (9), a thrust bearing (11) in between, and a cup fitting (12) at the end of extendable tube (9); numeral (10) is the tubular motor rotor, numerals (13) are coupling pins between extendable tube (9), rotor (10) and fitting cup (12); two switches (14) are used to set the rotational clockwise and counter clockwise ranges of the rotation.

Tubular tube assembly (7) is installed into one side wall through holes (15), and to an opposite wall bearing via fitting cup (12).

When electrically activated, rotor (10), extendable tube (9) and cup (12) rotate together round bearing (11) as one pivot, while the cup (12) serves as a second rotating pivot. In prior art, a shutter or a blind connected to the tube (9) wraps or unwraps in accordance with the rotation direction, in the novel suggested usage, a curtain or straps connected to tube (9) on one side and to HHVMC roof on the other side are used to vertically move the HHVMC, this method largely reduces possible cabinet deflections.

Figure 4:
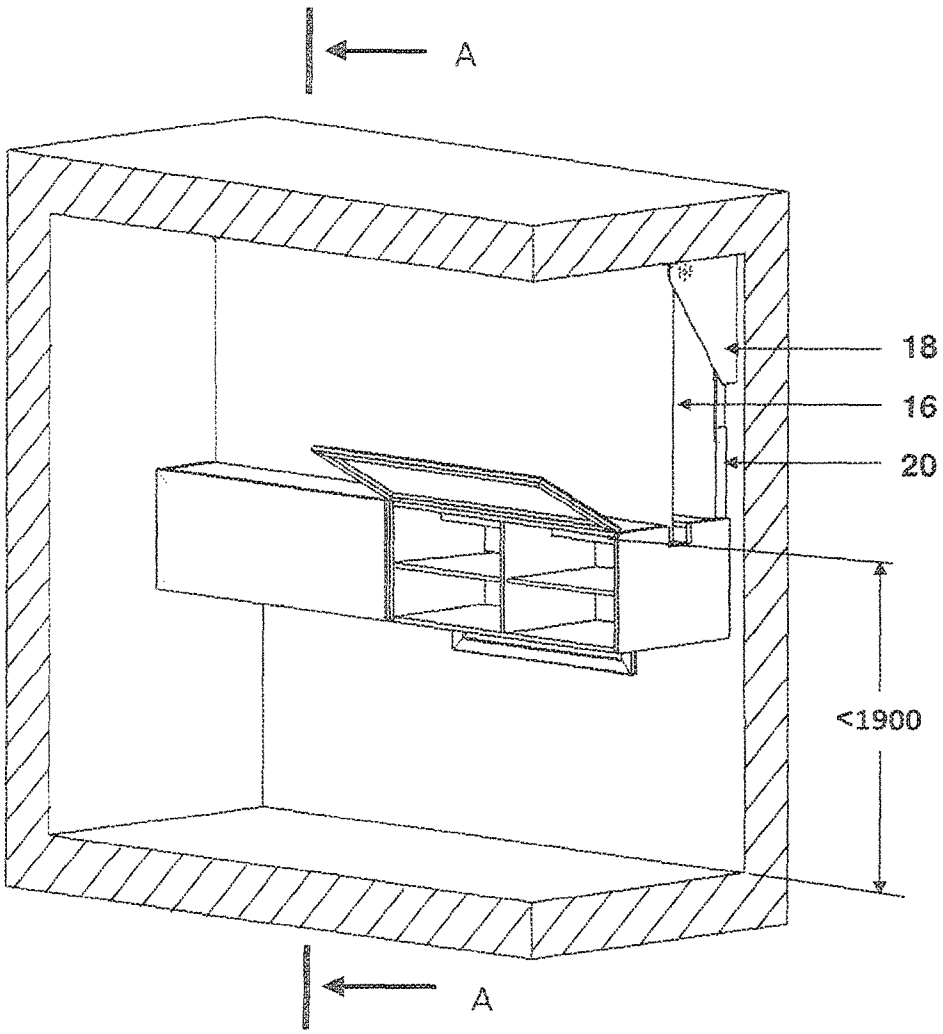
FIG. 4 is a front perspective sectional view of a room installed with a preferred suggested embodiment for HHVMC, shown in its lower position

FIG. 4 is a front perspective view of a suggested HHVMC, shown in a very lower posture, suitable for disabled persons or children, with one opened door and with a fully opened window in the background. It should be noticed that other type of doors could be applied; in addition, the interior of the HHVMC could be changed to drawers or shelves.

The HHVMC is hung on a "curtain" (16), made of a sheet of reinforced fabric, this sheet caries the HHVMC while equally distributing the load and preventing large deflections, in addition the curtain hides the motion and the anti-fall safety systems (to be shown and explained with more details in later figures).

Figure 5:
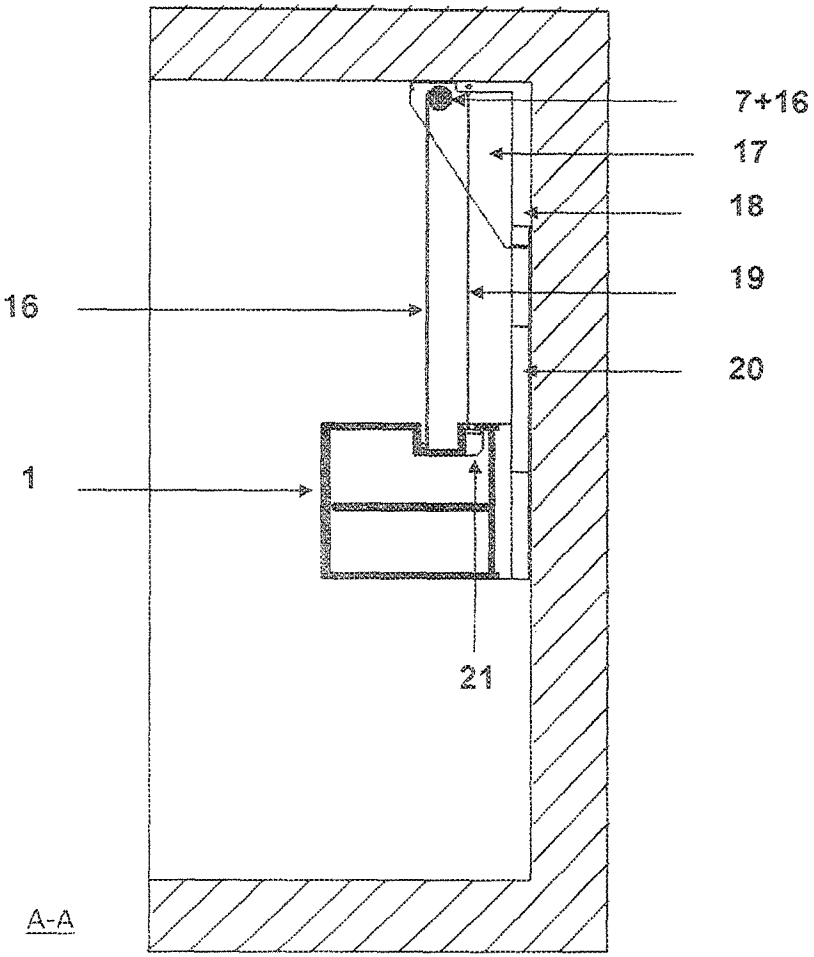
FIG. 5 is a sectional view through the suggested embodiment of HHVMC from FIG. 4, in its lower position.

FIG. 5 is a sectional view of previous FIG. 4; the cut goes through the room walls, HHVMC (1), tubular motor assembly (7) and "curtain" (16). In the background are seen: one of two consoles (17) carrying the tubular motor assembly (7), one of two consoles (18) carrying a retractable safety belt (19); one of two retractable safety belt wrapping mechanisms (21), and one of two telescopic rails (20) attached to console (18). More detailed explanation for this embodiment is given in conjunction with the following figures.

The suggested HHVMC movement is guided by two telescopic rails (20), connected to consoles (18), (one pair of console and rail is hidden behind "curtain" (16)). Further detailed explanation for this embodiment is given in conjunction with the coming figure.

Figure 6:
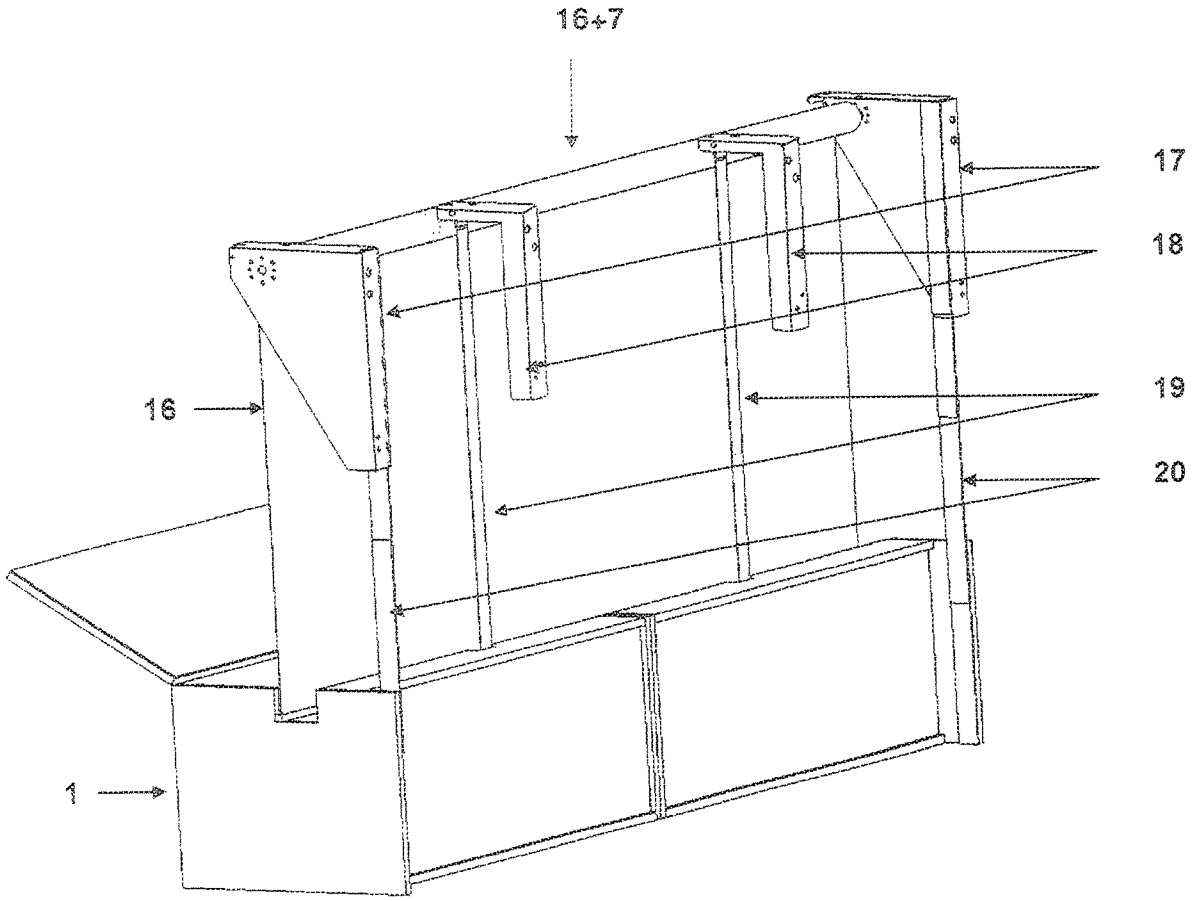
FIG. 6 is a rear perspective view of a preferred suggested HHVMC embodiment in its lower position.

FIG. 6 depicts a rear perspective view of the HHVMC from FIGS. 4 and 5, with the room wall removed.

"Curtain" (16), is all along attached to extendable tube (9) of tubular motor assembly (7), on one side and to a groove in the HHVMC roof, on the other side; rotation of tube (9), due to the tubular motor action, wraps/unwraps "curtain" (16), hence lifts or lowers the HHVMC.

As the HHVMC reaches the ceiling, tubular motor assemblies (7) together with the wrapped "curtain" (16) are entering the "U" shape groove opening, allowing for the HHVMC roof to almost touch the ceiling.

A reversed installation is also possible, to say: tubular motor assembly (7) is installed within the "U" shaped groove, while "'curtain" (16) is connected to the room ceiling; the minor drawbacks of this inversion are: the extra load on the motor that has to carry its own weight and in addition, the electrical supply cable to the motor, has to move together with the HHVMC (this reversed installation method is described later on, in conjunction with a CORNER HHVMC).

Two retractable car safety belts (19), are connected to belts consoles (18), on one side and to the upper HHVMC vertical interior surface on the other side (belt retracting mechanism (21) is shown in FIG. 5); in normal action the two belts wrap/unwrap together with "curtain" (16), but, in case of a mechanical failure, causing the HHVMC to drop (for instance disengagement of console (17) from the room ceiling or wall), the retractable belts stop the sudden falling. Due to safety or room walls and ceiling strength considerations, each of the four consoles 2×(17), (2×)18, may be secured both to the wall and/or to the ceiling, furthermore, the safety retractable belts are installed on separate consoles (18), which unlike the other ones, are only lightly loaded during normal operation and thus do not suffer significant loads and have a good probability to deal with such a failure separately from a possible failure with consoles (17).

Figure 7:
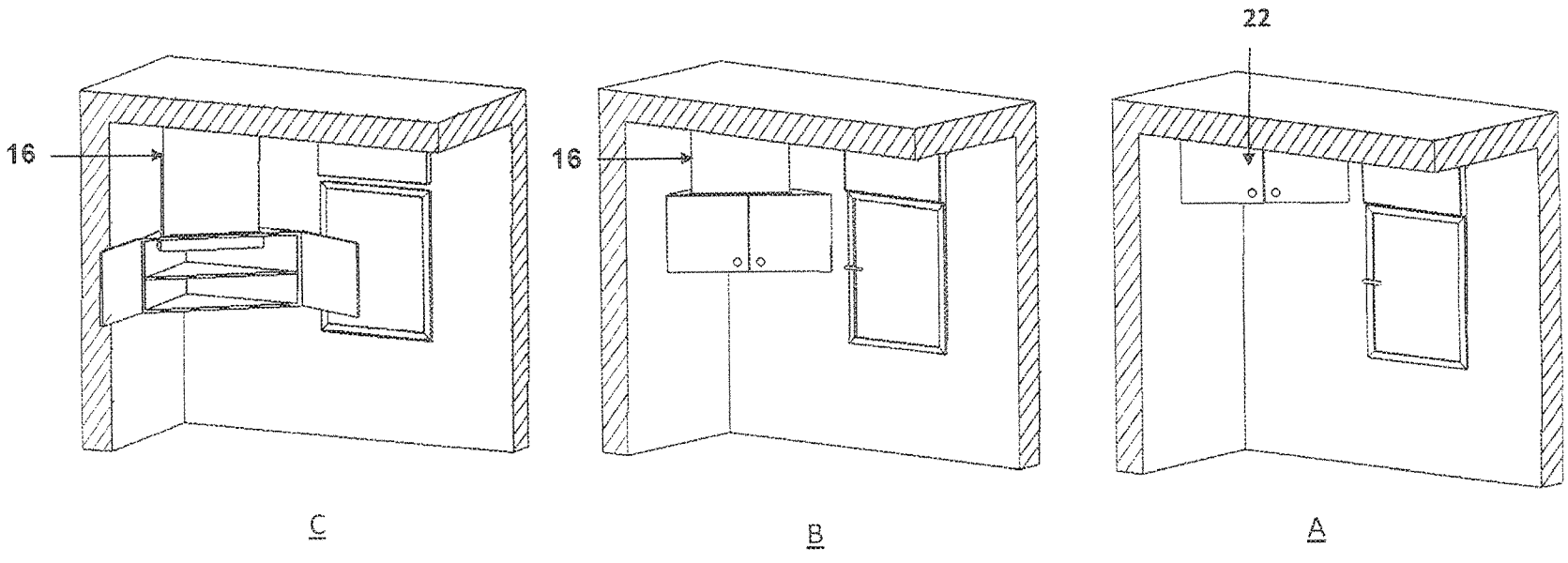
FIG. 7 is a perspective view of a CORNER HHVMC at three elevation levels.

FIG. 7 is a perspective view of a CORNER HHVMC (22) in three elevations levels. The suggested CORNER HHVMC has a shape of a right angle prism (triangular base and top) fitted to a room corner.

This uncommon shape of CORNER HHVMC is applicable where only small to medium amount of extra storage volume is needed; and in view of esthetical considerations. As in the figure, the two arms of the prism are not necessarily equals (could be helpful to deal with existing obstructions on the walls). As for the HHVMC, the CORNER HHVMC is hung on a "curtain" (16) connected to prior art tubular motor assembly (7) and vertically guided by two telescopic rails (hidden by the CORNER HHVMC and the curtain in this figure). As in previous case, rotation of the tubular motor wraps/unwraps curtain (16) to lift and lower the CORNER HHVMC as needed. More detailed explanation for this embodiment is given in conjunction with the coming figure.

Figure 8:
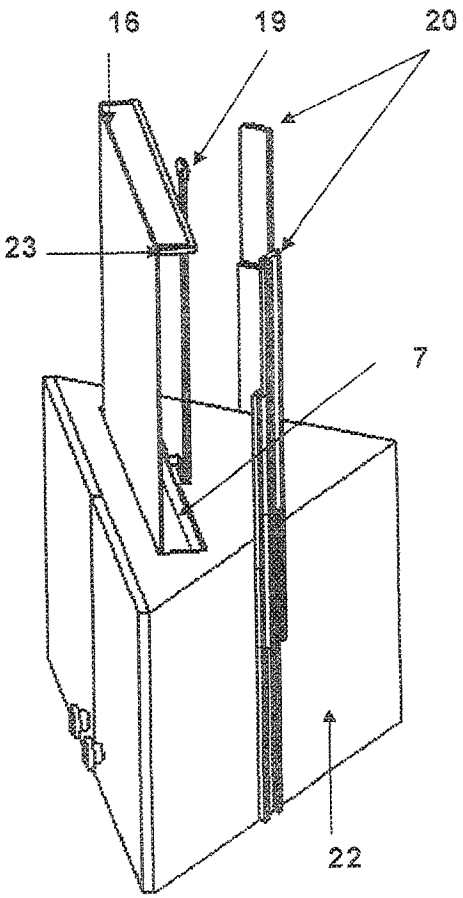
FIG. 8 is a perspective view of a preferred suggested CORNER HHVMC application from two different points of view.
Figure 8:
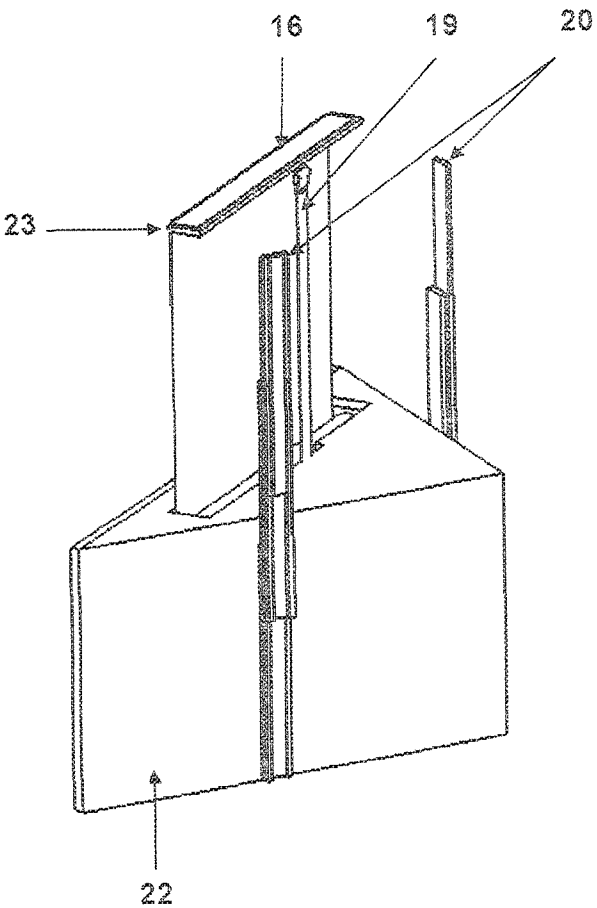

FIG. 8 is a perspective view of a CORNER HHVMC (22) from two different points of view with the room walls and ceiling removed. The CORNER HHVMC is hung to the ceiling through "curtain" (16) with the aid of bar (23); a retractable safety belt (19) is also attached to the ceiling on different anchoring point; not like the embodiment showed for the HHVMC, tubular tube (7) is connected to a "pouch" in the roof unit (this is not a necessity, furthermore, as mentioned previously, this embodiment may be used for the HHVMC as well).

Figure 9:
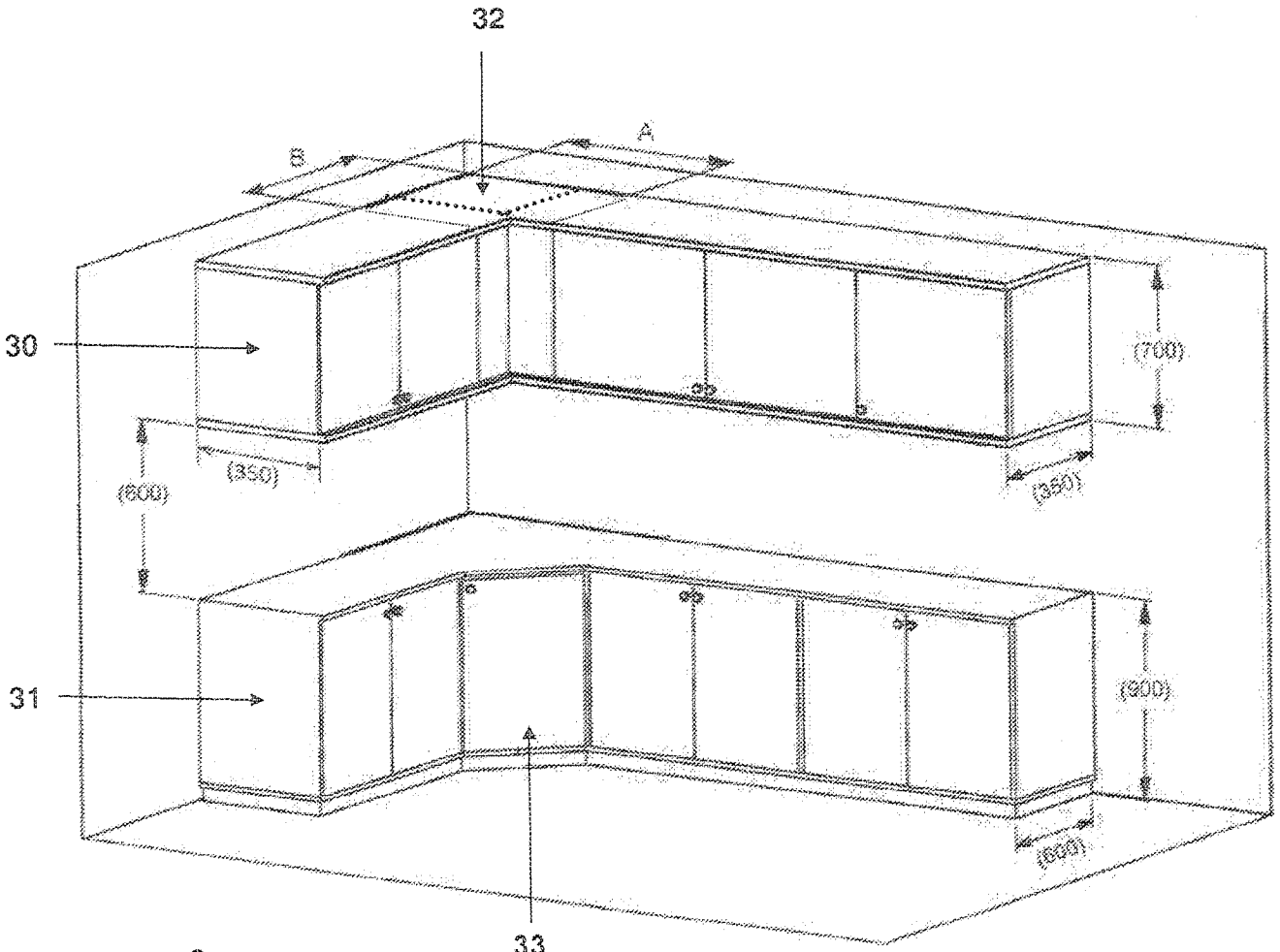
FIG. 9 is a perspective view of prior art corner kitchen cabinets

FIG. 9 is a perspective view of a prior art, corner kitchen comprising upper level cabinets (30) and lower level cabinets (31), typical dimensions are shown as well. The heavy dotted marked area (32), represents a volume with a poor accessibility; for the lower corner cabinet case this problem is solved using door (33) together with rotating trays, using drawers and so on; for the upper case, drawers or trays solutions are not an option, due to the relatively high level; in many cases this volume is left unused, in other cases door manipulation enables using this volume, with a degraded accessibility, due to the high level and the deepness of this volume.

The suggested solution for this case is a SHAFT CORNER HHVMC. It should be noted that this solutions may be extended to size "A" and "B" (and not only for the heavy dotted area mentioned earlier.

Like the two previously described HHVMC and the CORNER HHVMC, the solution is based on the following building stones:

- Using prior art tubular motor assembly as a novel motion system.
- Using wrapping straps (rather than a "curtain") as connecting elements to the tubular assembly motor.
- Using telescopic rails for vertically guiding the cabinet movement
- Using prior art retractable car safety belts as a novel anti drop means.

Figure 10:
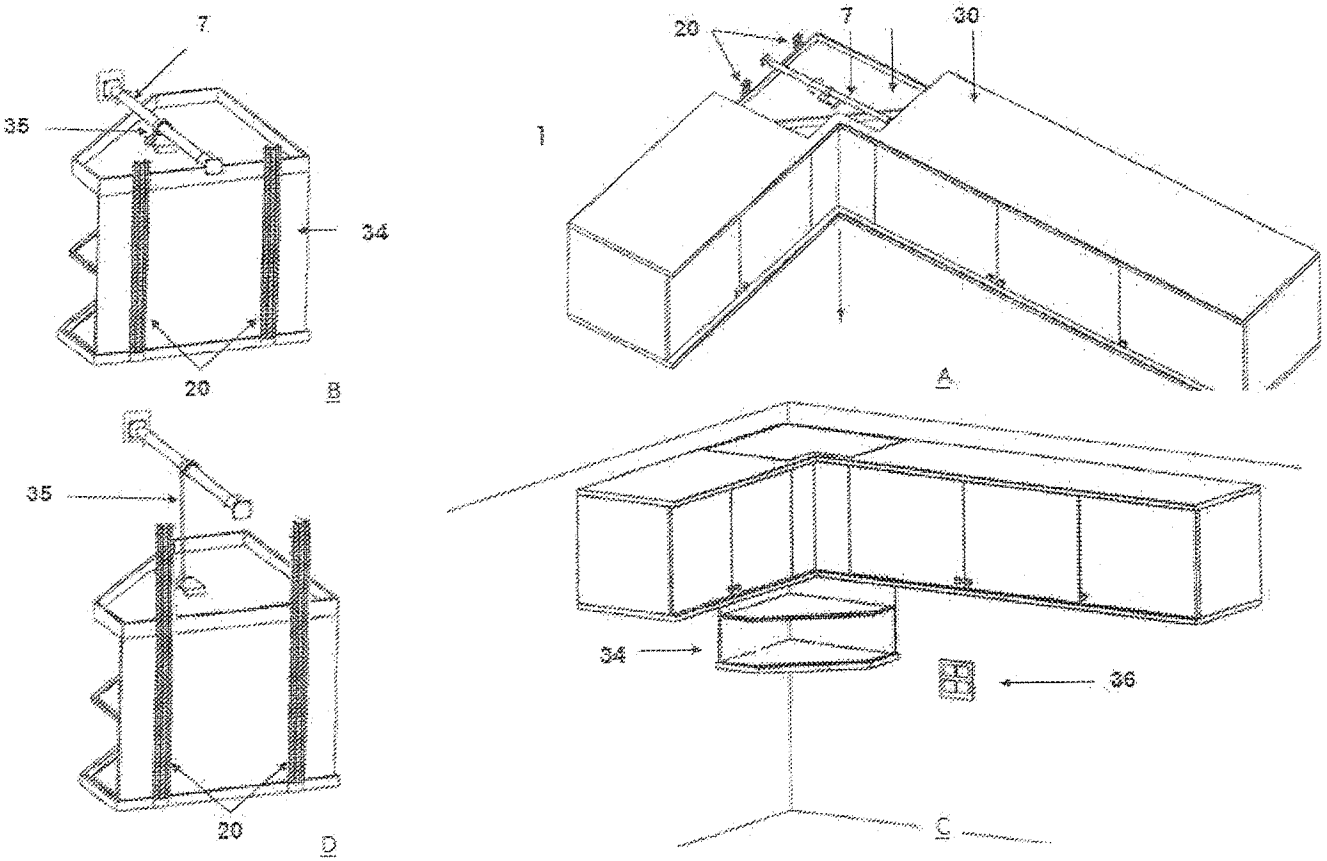
FIG. 10 shows four perspective views of an upper SCVMC embodiment coupled to prior art stationary upper corner kitchen cabinets

FIG. 10 shows four perspective views of upper SCVMC (34), the installation is within the shaft formed by two upper corner cabinets which are part of upper stationary kitchen cabinet (30), and the room corner.

Views "A" and "B" demonstrate the upper level position, while views "C" and "D" represent the lower one.

Tubular motor assembly (7), is installed above the upper SCVMC (34), with one end attached to the wall of the nearby stationary cabinet (30), while the other end is installed to the room wall; strap (35) is wrapped/unwrapped on the tubular motor assembly (7), to lift and lower the upper SCVMC (34); two telescopic rail (20) guide the upper SCVMC (34) in a vertical route.

Another installation option is hanging the tubular motor assembly (7) further higher, on top of cabinet (30) roof, thus more efficiently using the 700 mm height for storage volume; in this case, some esthetical price is involved, resulting from the visibility of the tubular motor assembly on top of stationary cabinets (30). One more installation option is to connect tubular motor assembly (7) to the roof of the upper SCVMC (34), in a similar way described in FIG. 8 for the CORNER HHVMC.

Prior art switch (36) (used to operate shutters and blinds), is used for lifting and lowering SCVMCs (34) and other depicted HHVMCs.

Figure 11:
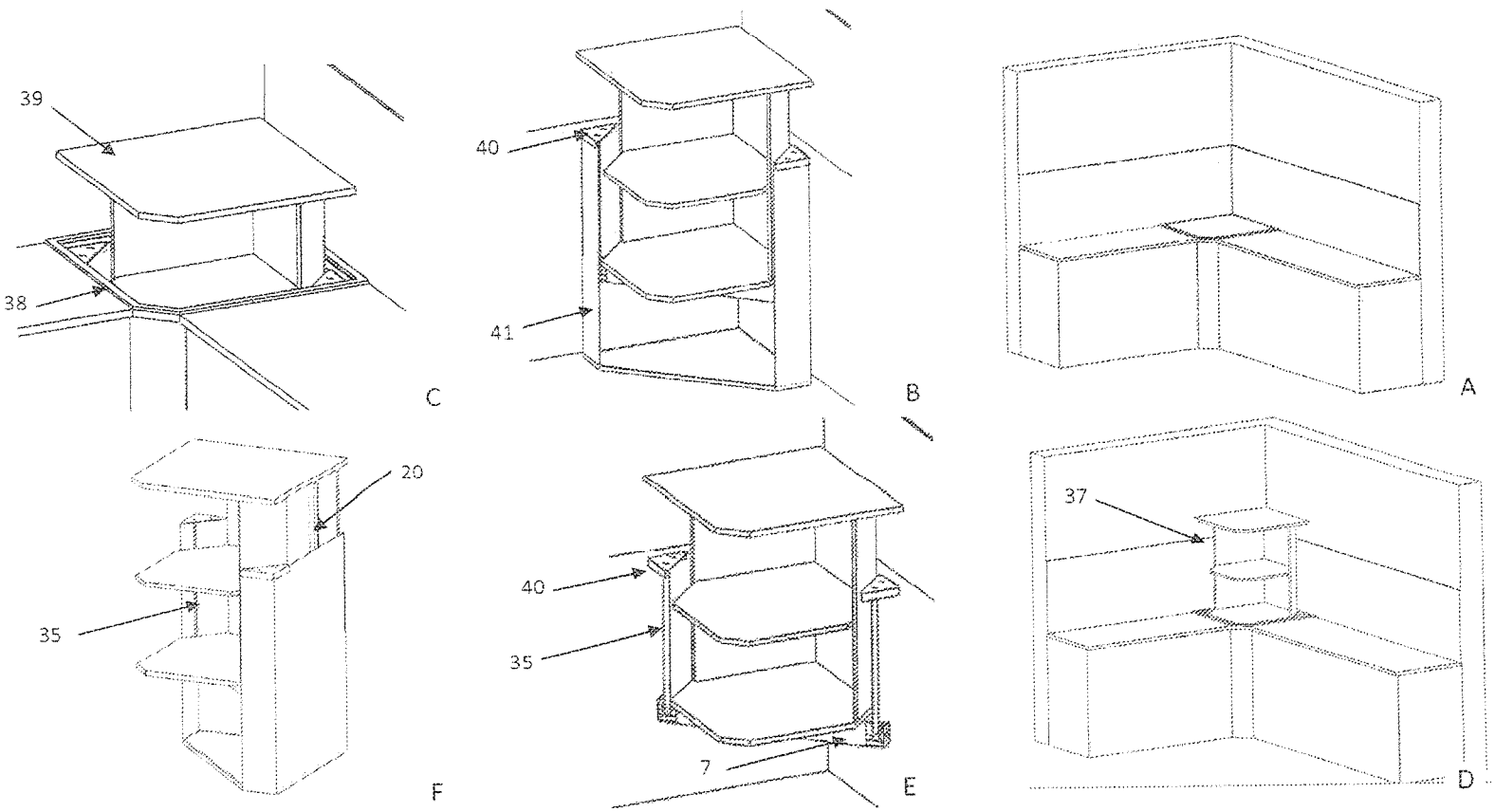
FIG. 11 shows six perspective views of a lower SCVMC embodiment coupled to prior art stationary lower corner kitchen cabinets

FIG. 11 shows six perspective views of upper SCVMC (37), the installation is within the shaft formed by two lower corner cabinets that are part of lower stationary kitchen cabinet (31), and the room corner.

Views "A" and "D" demonstrate the lower and upper level position, while the other views depict a suggested installation design.

Tubular motor assembly (7), is attached to the bottom of the lower SCVMC (37), two straps (35) are wrapped/unwrapped on the tubular motor assembly (7), the straps are attached to two strap anchoring brackets (40) positioned on a sheet metal shell construction (41) surrounding the lower SCVMC; two telescopic rail (20) connected to the sheet metal shell guide (41) one side and to the lower SCVMC (37) wall in the other side guide the lower SCVMC in a vertical route.

To avoid liquid leakage from the worktop down to the lower cabinets, an elevated banister (38) surrounds the opening in the desktop surface.

Due to esthetical consideration it is suggested that the lower SCVMC roof (39) is made of the same worktop material.

Figure 12:
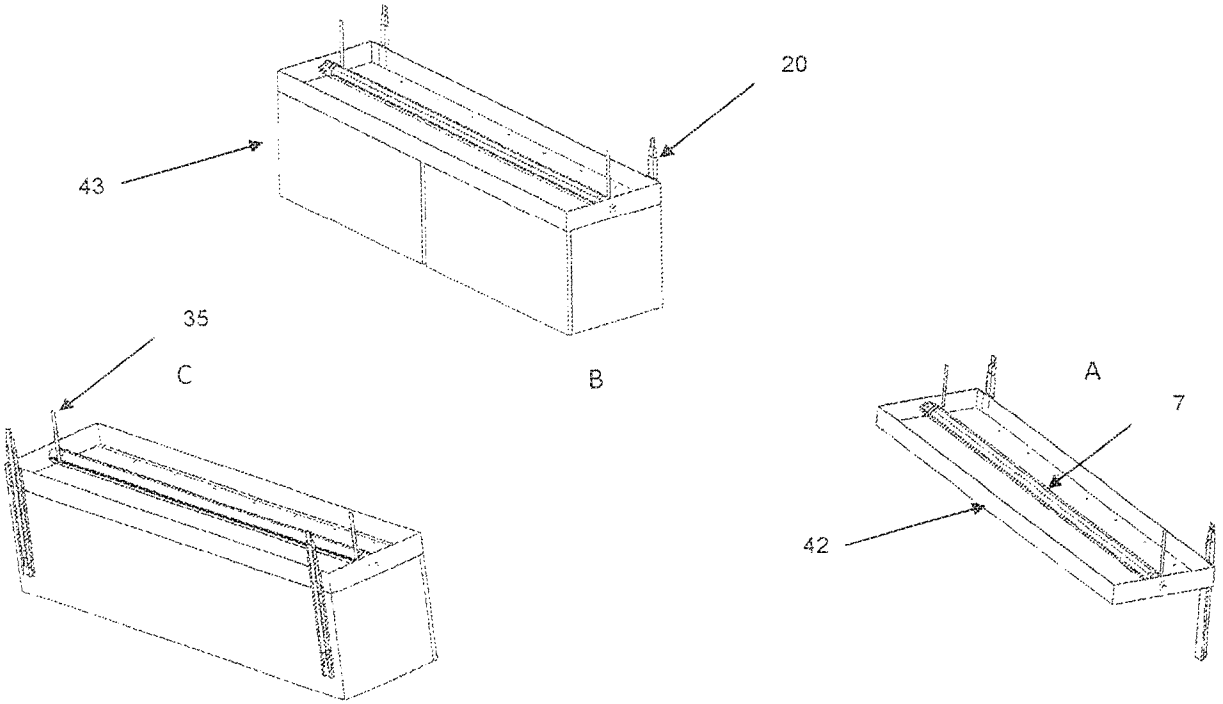
FIG. 12 depicts three perspective views of a retrofit kit installed on top of a regular cupboard.

FIG. 12 shows a basic concept allowing to use an existing cabinet as a HHVMC; this is achieved by using a retrofit kit (42), the kit comprises a cuboids shell installed with a tubular motor (7), two telescopic rails (20) and two straps (35).the retrofit kit is attached to the top of an existent cupboard. The rails are installed to the nearby wall while the two straps are attached to the ceiling.

LEGEND/REFERENCE SIGNS LIST

In the figures and/or description herein, the following reference numerals have been mentioned:

1. Highly Hung Vertical Moveable Cabinet (HHVMC).
2. Window opening
3. Window wing
4. Window shutter
5. Shutter compartment cover
6. Cabinet shelf
7. Tubular motor assembly
8. Gap between HHVMC and wall room
9. Extension tube
10. Rotor of the tubular motor
11. Thrust bearing
12. Cup fitting
13. Coupling pin
14. Tubular motor rotational range switches
15. Tubular motor installation holes
16. "Curtain"—a sheet of reinforced fabric.
17. Console carrying tubular motor assembly and telescopic rails.
18. Console carrying retractable vehicle safety belt.
19. Retractable vehicle safety belt
20. Telescopic rail
21. Retractable vehicle safety belt mechanism
22. CORNER HHVMC
23. Anchoring bar for a "curtain"
30. Upper corner stationary cabinet
31. Lower corner stationary cabinet
32. Corner rectangular area of upper stationary cabinet
33. Lower corner stationary cabinet diagonal door
34. SCVMC (Shaft Corner Vertically moveable cabinet)
35. Strap
36. Electrical wall shutter switch
37. Lower SCVMC
38. Elevated banister
39. Lower SCVMC roof
40. Strap anchoring bracket
41. Sheet metal shell
42. Retrofit kit from an existent to HHVMC The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitate the reading thereof. These reference numbers should not be interpreted as limiting the claims in any form.

The invention claimed is:

1. A Highly Hung Vertically Moveable Cabinet (HHVMC), comprising:

a cabinet having a bottom and a top essentially parallel thereto;

an electrical motion system including:

a first bracket configured for attachment to a ceiling, a second bracket configured for attachment to said ceiling independently of said first bracket and an electric tubular motor for wrapping a curtain attached between the cabinet and said first bracket; said electrical motion system configured to move the cabinet to a predetermined distance of at least 500 mm in a first direction and in a second opposite direction, both first direction and second direction being essentially normal to the bottom and top;

a retractable belt configured to remain attached between the cabinet and said second bracket independently from said tubular motor; said retractable belt passively extending and retracting as said cabinet is lowered and raised respectively;

a brake attached to said retractable belt to stop said extending in response to a sudden increased movement; and switches coupled to the electrical motion system, to allow selection of movement in the first or second direction.

2. The HHVMC of claim 1, further comprising at least two telescopic rails positioned on opposite sides of the cabinet, said rails configured to extend as the cabinet is lowered and stabilize vertical movement of the cabinet and wherein in raised position said cabinet hides said telescopic rails from a viewer standing in front of said cabinet and wherein in a lowered position said cabinet and said curtain hide said telescopic rails from a viewer standing in front of said cabinet.

3. An HHVMC according to claim 1, shaped as a right angle triangular prism.

4. The HHVMCs according to claim 1, having a single said tubular motor and installed in structures selected from a group comprising warehouses, storehouses, exhibition halls and houses, wherein the cabinet comprises an array of cabinets positioned one next to another and attached together to be raised and lowered as a unit; and wherein said first and second brackets are attached proximal to ceiling areas in the structures.

5. The HHVMC according to claim 4, wherein structures comprise floors, and wherein the array of cabinets of the HHVMC is installed such that in a raised position a distance between the bottom and the floor is at least 1900 mm.

6. The HHVMC according to claim 1, which further comprises means to allow manually moving the cabinet the predetermined distance in at least one direction as a backup system.

7. Installing an array of HHVMCs according to claim 1, in built spaces selected from the group consisting of warehouses, storehouses, exhibition halls, etc., wherein the array of HHVMCs are installed one next to the other on ceiling areas in the built spaces and wherein the array of HHVMCs provides large storage volume in high zones of the built spaces.

8. The HHVMC of claim 1, wherein said retractable belt includes a mechanism configured for installation into a car as a safety belt.

9. The HHVMC of claim 1, further comprising:

a groove in the top of the cabinet housing at least part of the tubular motor and at least part of the curtain behind storage space inside the cabinet when the cabinet is proximal to the ceiling.

10. A method comprising:

installing a Highly Hung Vertically Moveable Cabinet (HHVMC) provided with an electrical motion system at an upper volume of a built space with some 1900 mm clearance between a bottom of the HHVMC and a floor of the built space, in an up most travel position of the HHVMC;

providing at least two telescopic rails to stabilize vertical motion of the HHVMC; and lowering and lifting the HHVMC about 500 mm and more using the electrical motion system comprising a curtain, or at least one curtain used as a medium to lift and lower the HHVMC by wrapping/unwrapping around a tubular motor, housing at least part of the tubular motor and said at least part of said curtain in a groove in a top of the cabinet housing while the cabinet is proximal to a ceiling with said part of said curtain behind a portion of storage space in the cabinet;

wherein the clearance enables installation above windows and doors in the built space;

wherein the HHVMC has an aspect ratio higher than 1:1 to gain access to stored items in the HHVMC;

stabilizing vertical movement of the cabinet with at least two telescopic rails positioned on opposite sides of the cabinet, said rails configured to extend as the cabinet is lowered;

hiding said telescopic rails from a viewer standing in front of said cabinet with said cabinet when said cabinet is in a raised position; and hiding said telescopic rails from a viewer standing in front of said cabinet with cabinet and said curtain when said cabinet is in a lowered position.

11. The method according to claim 10, wherein the HHVMC is shaped as a right angle triangular prism with door/s at its hypotenuse, allowing good accessibility to stored items within the HHVMC, wherein the HHVMC is installed at vertical corners of the built space.

12. The method according to claim 10, further comprising means to allow manually moving the cabinet in at least one vertical direction as a backup system.

13. A Highly Hung Vertically Moveable Cabinet (HHVMC), comprising:

a cabinet having a bottom and a top essentially parallel thereto;

an electrical motion system including a tubular motor for wrapping a curtain attached between the cabinet and a ceiling configured to move the cabinet to a predetermined distance of at least 500 mm in a first direction and in a second opposite direction, both first direction and second direction being essentially normal to the bottom and top;

switches coupled to the electrical motion system, to allow selection of a movement in the first or second direction;

a groove in the top of the cabinet housing at least part of said tubular motor and a portion of said curtain behind storage space in the cabinet when the cabinet is proximal to the ceiling; and at least two telescopic rails positioned on opposite sides of the cabinet, said rails configured to extend as the cabinet is lowered and stabilize vertical movement of the cabinet and wherein in raised position said cabinet hides said telescopic rails from a viewer standing in front of said cabinet and wherein in a lowered position said cabinet and said curtain hide said telescopic rails from a viewer standing in front of said cabinet.

14. An HHVMC according to claim 13, wherein said cabinet is configured to fit into a SHAFT CORNER Movable Cabinet as an insert installed within a trapped volume of a corner kitchen cabinet.

15. A method of using a SHAFT CORNER Movable Cabinet according to claim 6, the method comprising:

installing the SHAFT CORNER Movable Cabinet with the electrical motion system at a shaft formed by a kitchen room corner;

lowering and lifting the SHAFT CORNER Movable Cabinet in a space under and behind the upper kitchen wall cabinets by the electrical motion system; and stabilizing the lowering and lifting with two or more telescopic rails.

16. The method according to claim 15, further comprising restraining dropping due to technical failure of the SHAFT CORNER Movable Cabinet with a retractable belt configured to remain attached between the cabinet and at least one of a wall and said ceiling of a built space independently from said tubular motor; said retractable belt passively extending and retracting as said cabinet is lowered and raised respectively and wherein said restraining is by a brake attached to said retractable belt to stop said extending in response to a sudden increased movement.

17. An HHVMC according to claim 13, shaped as a right angle triangular prism.

18. the HHVMC according to claim 13, having a single said tubular motor and installed in structures selected from a group comprising warehouses, storehouses, exhibition halls and houses, wherein the cabinet comprises an array of cabinets positioned one next to another and attached together to be raised and lowered as a unit.

19. The HHVMC according to claim 18, wherein structures comprise floors, and wherein the array of cabinets of the HHVMC is installed such that in the raised position a distance between the bottom and the floor is at least 1900 mm.

20. The HHVMC according to claim 13, which further comprises means to allow manually moving the cabinet the predetermined distance in at least one direction as a backup system.

* * * * *